United States Patent [19]

Cousins et al.

[11] Patent Number: 4,890,944

[45] Date of Patent: Jan. 2, 1990

[54] CONTAINER AND DELIVERY SYSTEM FOR STICK COMPOSITIONS

[75] Inventors: Michael A. Cousins, New York; June Lee, Woodside, both of N.Y.

[73] Assignee: Bristol-Myers Company, New York, N.Y.

[21] Appl. No.: 566,051

[22] Filed: Dec. 27, 1983

[51] Int. Cl.[4] ..... A45D 40/00; A45D 40/08; A45D 40/16

[52] U.S. Cl. ..... 401/98; 401/68; 401/75; 401/132; 401/173

[58] Field of Search ..... 401/173, 98, 132, 75, 401/68; 206/606, 623; 220/212, 213, 258; 215/228

[56] References Cited

U.S. PATENT DOCUMENTS

| | | | |
|---|---|---|---|
| 429,040 | 5/1890 | Lum | 401/98 X |
| 666,452 | 1/1901 | Zucker | 206/606 X |
| 1,134,427 | 4/1915 | Ullrich | 220/212 |
| 1,203,308 | 10/1916 | Brown | 401/173 |
| 1,280,700 | 10/1918 | Fouche . | |
| 2,519,271 | 8/1950 | Miller | 222/386 |
| 2,980,246 | 4/1961 | Leshin | 206/56 |
| 3,333,740 | 8/1967 | Waller | 401/75 X |
| 3,397,027 | 8/1968 | Harrison | 401/98 X |
| 3,429,432 | 2/1969 | Cabernoch et al. | 206/623 |
| 3,443,874 | 5/1969 | Pelli et al. | 401/82 |
| 3,589,821 | 6/1971 | Barney et al. | 401/75 |
| 3,811,591 | 5/1974 | Novitch | 215/12 R |
| 3,873,008 | 3/1975 | Jahn | 222/390 |
| 3,917,417 | 11/1975 | Lang | 401/75 |
| 4,150,761 | 4/1979 | Collins | 215/228 |
| 4,230,230 | 10/1980 | Mumford | 215/321 |
| 4,298,036 | 11/1981 | Horvath | 141/1 |

FOREIGN PATENT DOCUMENTS

| | | | |
|---|---|---|---|
| 615280 | 7/1935 | Fed. Rep. of Germany | 401/173 |
| 2353053 | 6/1974 | Fed. Rep. of Germany | 206/623 |
| 599730 | 11/1959 | Italy | 401/98 |

*Primary Examiner*—Steven A. Bratlie
*Attorney, Agent, or Firm*—G. Warzecha

[57] ABSTRACT

A container and delivery system for storing and delivering material (preferably in stick form) to a surface which comprises a product holding portion and a product advancing portion, the producing holding portion being formed into a cap forming section and a product section, the cap forming section being adapted to be separated from the product section and inverted to serve as a cap for the system.

9 Claims, 3 Drawing Sheets

FIG. 1
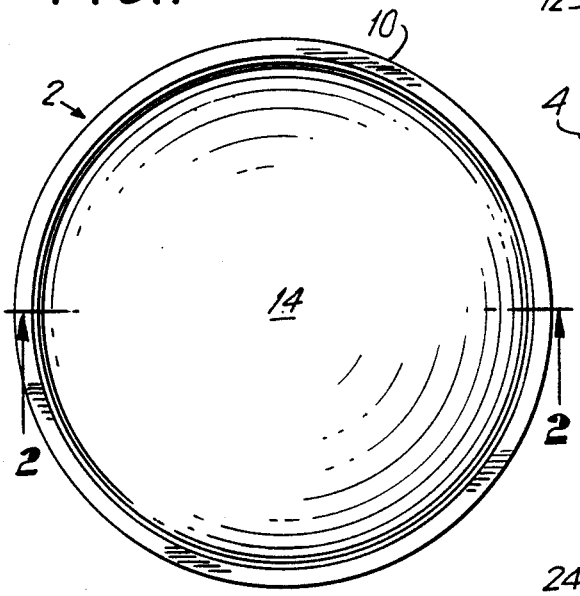
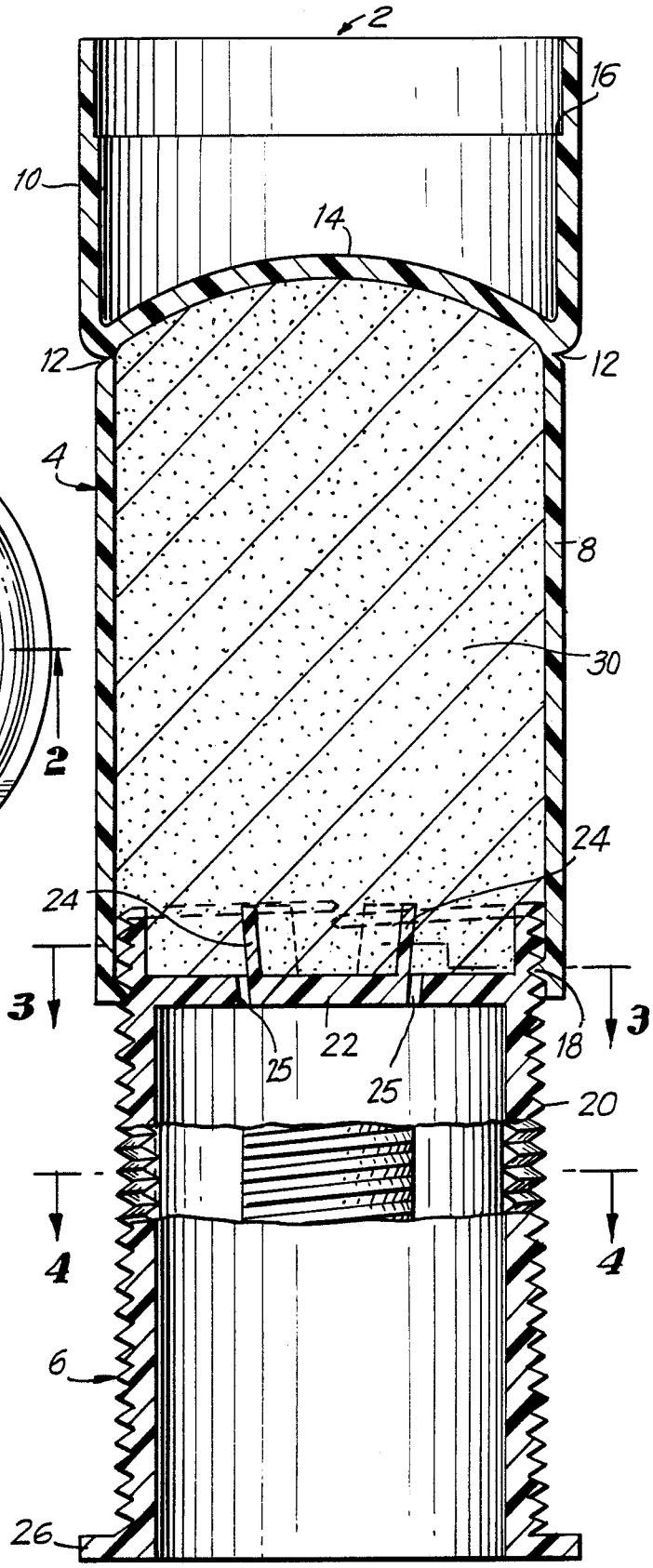
FIG. 2

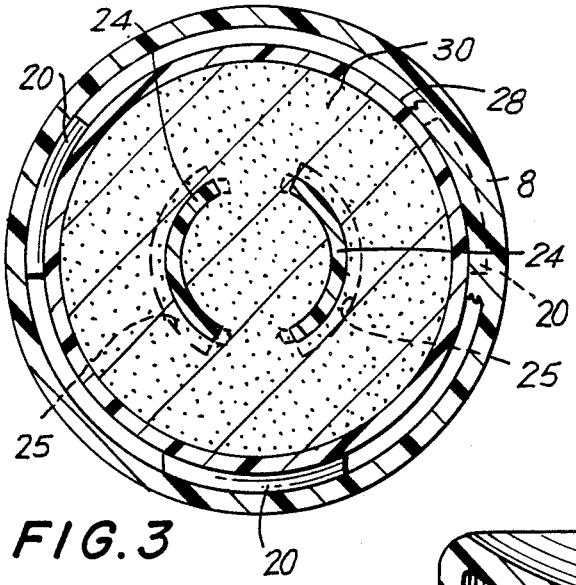
FIG. 3
FIG. 4
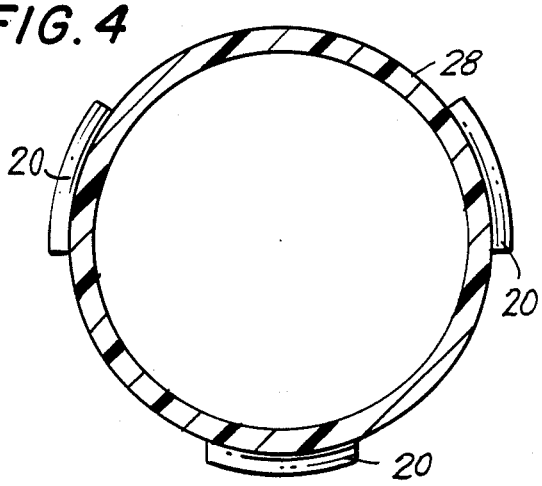
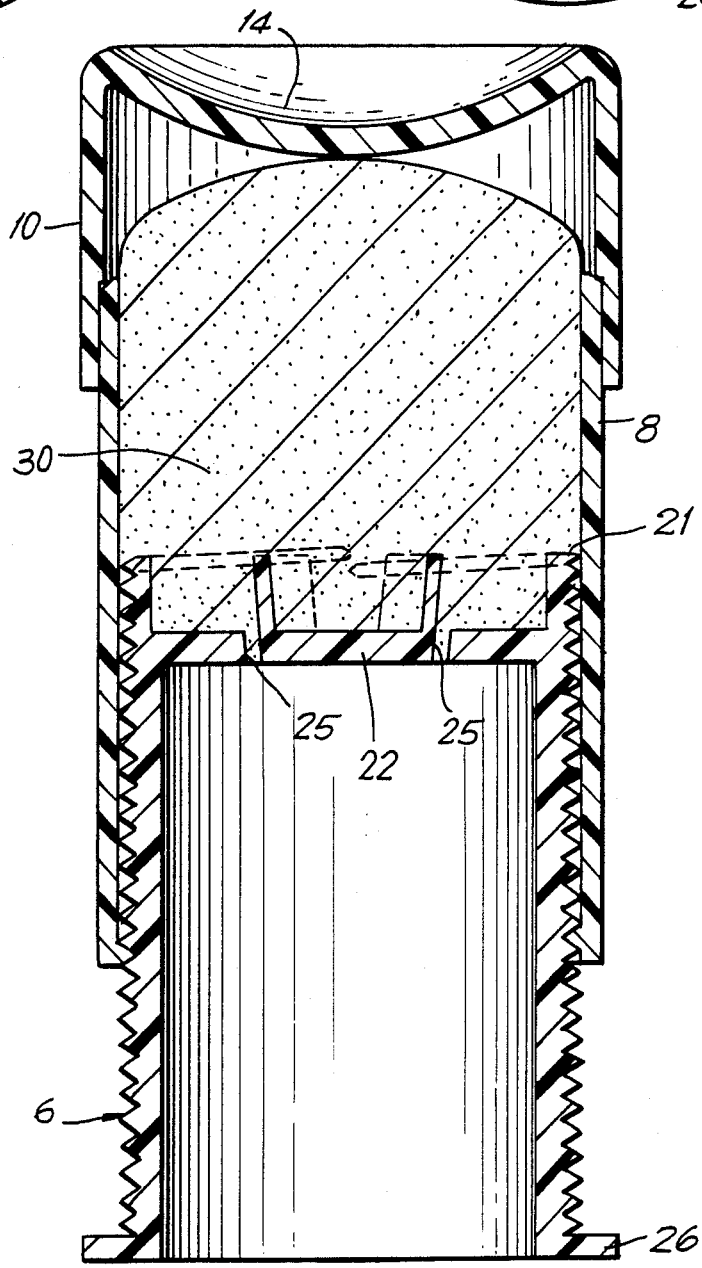
FIG. 5

CONTAINER AND DELIVERY SYSTEM FOR STICK COMPOSITIONS

This invention relates to a container and delivery system for storing and delivering material. More particularly, it concerns devices of this character which are adapted to apply the product to a surface. It has special application for the storing and delivering product material which is formed in the shape of a stick. Such sticks may contain active materials as in the case of antiperspirant sticks.

Container dispensers for cosmetics in solid stick form are well known in the art. These, however, are generally inclined to be quite complicated in construction requiring the formation of a number of components which are then required to be assembled. The present invention provides a simplified construction requiring, generally, no more than two pieces. In addition, this construction permits the simple filling of the container with product.

This invention is illustrated by the constructions shown in the attached drawings wherein:

FIG. 1 is a top plan view of a container and delivery system embodied in the present invention;

FIG. 2 is a longitudinal cross-sectional view of the device shown in FIG. 1 taken along 2—2 of FIG. 1;

FIG. 3 is a transverse cross-sectional view of the device shown in FIG. 2 taken along line 3—3;

FIG. 4 is also a transverse cross-sectional view through the device shown in FIG. 2 but in this instance, the view is taken through line 4—4 of FIG. 2;

FIG. 5 is a longitudinal section through the container delivery system shown in FIG. 1 and similar to that shown in FIG. 2; in this instance, however, the separable cap has been separated from the device shown in FIG. 2 and inverted to serve as a closure for the container and the product advancing means is shown partly advanced up in the product holding portion of the container;

Figure 7:
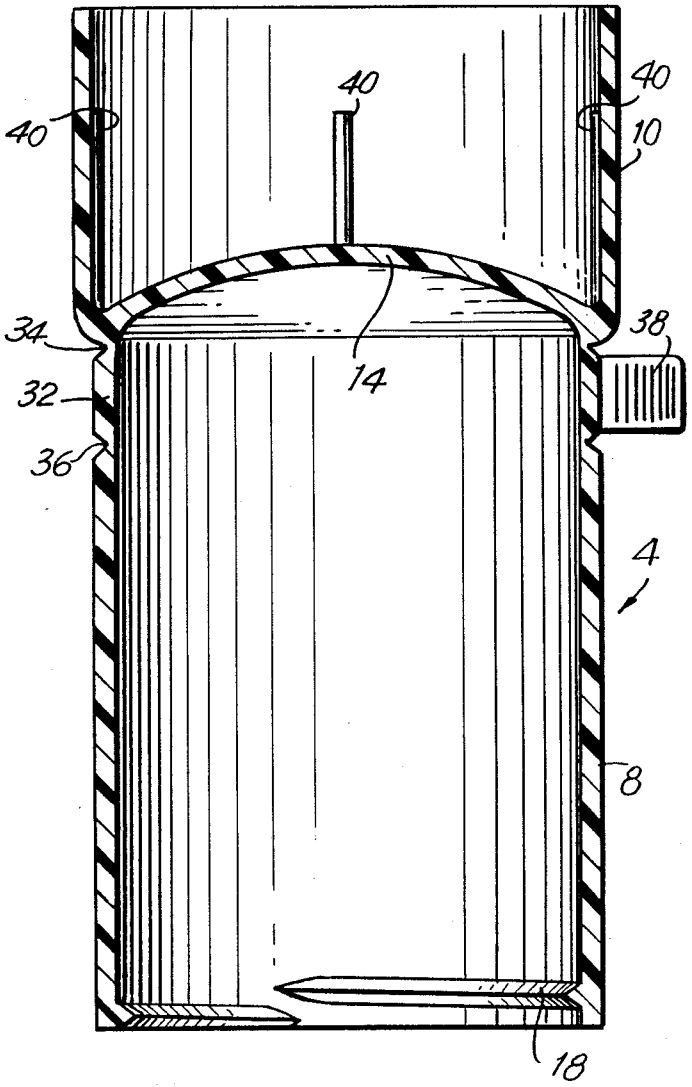
FIG. 7 is a longitudinal cross-sectional view of the device shown in FIG. 6 taken along line 7—7.

Referring to the drawings in which the same numerals in the various figures represent the same structure, a container and delivery system embodied in this invention is shown generally at 2 and comprises a product holding portion 4 and a product advancing portion 6. Product holding portion 4 comprises a product section 8 and a cap forming section 10 molded together as a single piece. In the modification shown in FIG. 2, a notch 12 is cut into said molded unitary piece at the junction of the product section 8 and cap forming section 10. This weakens the wall of the molded piece at this junction and facilitates the separation of the cap forming section 10 from the product section 8 as described in more detail below.

Product holding portion 4 is provided with a domed shape partition 14 which extends across its entire internal dimension. Partition 14 serves as the roof of cap forming section 10 when the latter is separated from product section 8. In addition, partition 14 serves as the floor of product section 8 when the latter is being filled with product. The dome shape of partition 14 should allow for better tear off of cap forming section 10 without damaging the corners of the product.

Cap forming section 10 on its interior surface is also provided with a step 16 which extends around the internal wall of cap forming section 10. Step 16 serves as a seat for cap forming section 10 when the latter is separated from product forming section 8 and inverted to serve as a cap.

In the modification illustrated in FIG. 1 through 5, product section 8 at its lower extremity is provided with a single internal thread 18. This mates with external threads 20 which are formed on the outer surface of product advancing portion 6 as described in more detail below.

Product holding portion 4 is formed as a hollow cylinder having an open lower end. Similarly, the cap forming section 10 before it is separated from product section 8 also has an open upper end.

Product advancing portion 6 is also cylindrical in shape and as indicated above, is provided with external threads 20. The upper end of product advancing portion 6 is provided with a roof 22 from which extend upwardly a pair of semi-circular product engaging lugs 24. In the modification illustrated, product advancing portion 6 is hollow. In addition, it is provided with a lower outwardly flange 26 which serves as the base for the total assembly. By virtue of flange 26, the whole assembly is self-standing. The outer diameter of flange 26 and cap forming portion 10 are preferably made equal to allow for production line handling and packaging.

In the modification illustrated, the top external thread 21 will complete the full circumference to provide an improved product seal. However, the remaining external threads 20 do not extend around the whole circumference of product advancing portion 6. They are rather formed as three interrupted threads 20 that extend outwardly from wall 28 of product advancing portion 6. This relationship is best seen with reference to FIG. 4. It is to be understood, however, that interrupted threads 20 may be formed into four or more sections.

As will be noted from FIG. 1 the wall of engaging lugs 24 are tapered upwardly and outwardly. To allow the molding of the undercut formed by lugs 24 the molding tools are designed to that they form semicircular slots 25 in roof 22 adjacent to the base of lugs 24.

In use, the product holding portion 4, separated from the product advancing portion 6, is inverted and filled with molten product 30 such as an antiperspirant stick composition adapted to form an antiperspirant stick. Product advancing portion 6 is then threaded a short distance into product section 8 so that product lugs 24 become immersed in the molten product 30. This is then allowed to cool so as to form the product stick. The dome shape of partition 14 causes the stick to be formed with an upper curve surface. The assembly is now ready to be packaged.

When the consumer is ready to use the product, the assembly is removed from the protective package. Cap forming section 10 is then broken away from product section 8 thus exposing the upper surface of the formed stick. The product can then be applied to a surface such as the underarm in the case where the product is an antiperspirant stick. As the product is used up, the stick can be advanced upwardly by rotating the product advancing portion 6. Cap forming section 10 separated from the product section 8 can then be inverted to serve as a cap for the assembly. This is best seen in FIG. 5 which shows the cap forming section in its inverted position serving as a cap.

Figure 8:
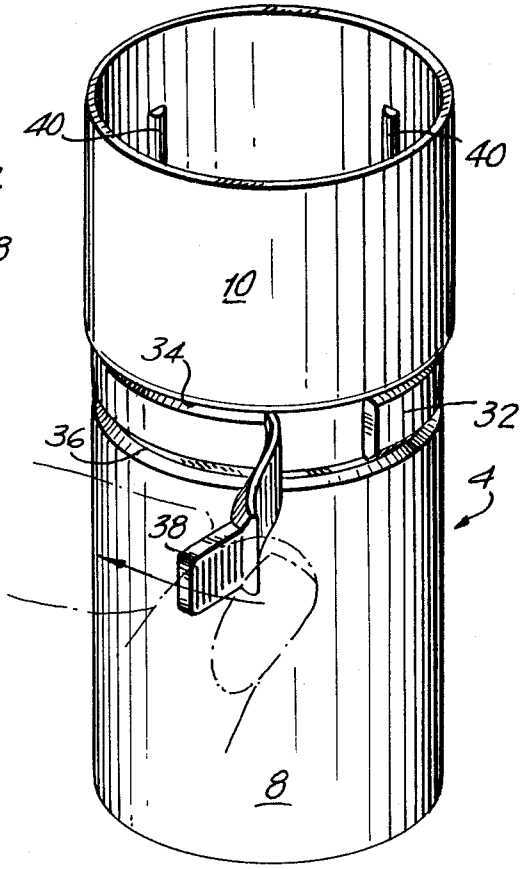
FIG. 8 is a view similar to that shown in FIG. 6 but illustrating the manner in which the tab is grasped and pulled to separate the cap portion from the product holding portion.
Figure 6:
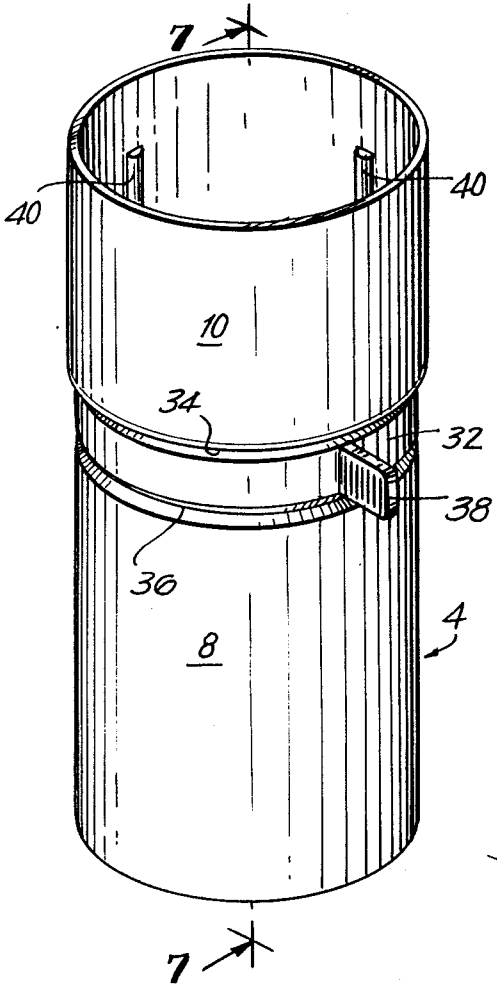
FIG. 6 is a perspective view of another modification of this invention showing the product holding portion which is provided with a tab means for separating the cap forming section from the product section of the product holding portion.

In FIGS. 6, 7 and 8 another modification of this invention is illustrated. In this case, only the product holding portion 4 is depicted. It is understood that in this modification the product advancing portion illustrated in the modification shown in FIGS. 1 through 5 may also be employed.

In the modification of FIGS. 6 through 8, the product holding portion 4 is also molded as a unitary piece. In this case, however, a band 32 is cut into the outer wall of product section 8 near its upper end by means of an upper and lower notch 34 and 36 respectively. Integral with band 32 is a pull tab 38. Distributed around the internal surface of cap section 10 there is provided a plurality of stops 40; the upper ends of which are spaced from the end of cap forming section 10.

In use, to separate the product section from the cap forming section, tab 38 is grasped between the fingers as best shown in FIG. 8 and the band 32 is peeled off. The cap forming section thus separated from the product section can then be inverted to serve as a cap for the assembly. In this instance, the stops 40 inverted from the position shown in FIG. 7 engages the lip formed at notch 36 when band 32 has been removed.

What is claimed is:

1. A container and delivery system for storing and delivering material for application to a surface, comprising a product holding portion having a hollow interior with inner and outer surfaces and a product advancing portion, (a) said product holding portion being open at each end and divided into a product section and cap forming section which are molded together in a single piece, the division into two sections being by means of a partition that extends across said hollow interior of said product holding portion, said product section containing the material to be stored and dispensed, said cap forming section being adapted to be separated from said product section and to carry with it on the separation said partition which will serve as the roof for the cap that is formed upon separation, the cap formed thereby being adapted to fit onto and close the open end of said product section, said open end being formed by the separation of said cap forming section from said product section, (b) said product advancing portion being inserted into said product holding portion through said open end of said product holding portion that is remote from said cap forming section, said product advancing portion being adapted to cooperate with said product holding portion to advance said material through said product holding portion.

2. A container and delivery system according to claim 1 in which said material contained in said product section takes the form of a stick.

3. A container and delivery system according to claim 2 in which said product holding portion and said product advancing portion are substantially circular in cross section.

4. A container and delivery system according to claim 2 in which said outer surface of said product holding portion is provided with means adjacent said partition to facilitate the separation of said cap section from said product section.

5. A container and delivery system according to claim 4 in which said means for facilitating the separation of said cap section from said product section is a weakened portion of reduced thickness in said outer surface of said product holding portion which facilitates the breaking away of said cap section from said product section.

6. A container and delivery system according to claim 4 in which the interior wall of said product section is provided with at least one thread that cooperates with threads provided on the exterior surface of said product advancing portion whereby the turning of said product advancing portion in said product holding portion causes said product advancing portion to move through said product holding portion and to push said stick material through said product holding portion.

7. A container and delivery system according to claim 6 in which said product advancing portion is provided with means for gripping said stick material.

8. A container and delivery system according to claim 1 in which said product holding portion and said product advancing portion are each molded as single pieces.

9. A container and delivery system according to claim 1, wherein said product advancing portion extends outwardly from said product holding portion when said product holding portion is full with the product, and said product advancing portion ranges increasingly into said product holding portion as the product is increasingly used up.

* * * * *